US012733762B2

(12) United States Patent
Brown et al.

(10) Patent No.: US 12,733,762 B2
(45) Date of Patent: Sep. 15, 2026

(54) BEVERAGE TRAY AND RETAINER

(71) Applicant: Teak Isle Manufacturing, Inc., Ocoee, FL (US)

(72) Inventors: Patrick Brown, Longwood, FL (US); Sean Ciervo, Clermont, FL (US); Angel Ruslan Salcedo Colon, Ocoee, FL (US)

(73) Assignee: Teak Isle Manufacturing, Inc., Ocoee, FL (US)

( * ) Notice: Subject to any disclaimer, the term of this patent is extended or adjusted under 35 U.S.C. 154(b) by 0 days.

(21) Appl. No.: 18/965,571

(22) Filed: Dec. 2, 2024

(65) Prior Publication Data

US 2025/0089921 A1 Mar. 20, 2025

Related U.S. Application Data

(62) Division of application No. 17/738,853, filed on May 6, 2022, now Pat. No. 12,185,854, which is a division of application No. 16/584,303, filed on Sep. 26, 2019, now Pat. No. 11,350,779.

(51) Int. Cl.

| | |
|---|---|
| ***A47G 23/06*** | (2006.01) |
| ***A47G 23/02*** | (2006.01) |
| ***B65D 1/34*** | (2006.01) |

(52) U.S. Cl.

CPC ..... *A47G 23/0641* (2013.01); *A47G 23/0208* (2013.01); *B65D 1/34* (2013.01)

(58) Field of Classification Search

CPC ..... A47G 23/0641; A47G 23/0208; A47G 23/02; A47G 23/0225; A47G 23/0216; A47G 23/0241; A47G 2023/0291; A47G 23/03; A47G 23/06; A47G 23/0608; A47G 23/0616; A47G 23/0625; A47G 23/0633; B65D 1/34; A47B 73/00; A47B 73/004; A47B 73/008; A47F 7/28

See application file for complete search history.

(56) References Cited

U.S. PATENT DOCUMENTS

| | | | | |
|---|---|---|---|---|
| 126,374 A * | 5/1872 | Bonington | ..... | A47B 13/16 131/241 |
| 225,187 A * | 3/1880 | Warren | ..... | D06F 81/06 108/97 |
| 402,788 A * | 5/1889 | Wagandt | ..... | H05K 7/12 248/506 |
| 1,486,762 A * | 3/1924 | Jones | ..... | A47L 13/512 248/113 |

(Continued)

OTHER PUBLICATIONS

U.S. Pat. No. 225,187 to E.W. Warren, issued Mar. 2, 1880.

(Continued)

*Primary Examiner* — Devin K Barnett

(74) *Attorney, Agent, or Firm* — Taft, Stettinius & Hollister LLP

(57) ABSTRACT

The present invention broadly relates to trays, tables, and storage compartments capable of securely holding glasses and other containers for beverages and other liquids. For example, the trays, tables, and storage compartments may include a retainer portion with a retainer that is adapted to flex to receive a portion of a glass or other container for a beverage or other liquid. The flexing of the retainer also applies a gripping friction force to securely hold the glass or other container.

6 Claims, 11 Drawing Sheets

(56) References Cited

U.S. PATENT DOCUMENTS 1,541,672 A * 6/1925 Tulay ..... A61J 7/0069 206/199
1,705,236 A * 3/1929 Buckley ..... A47G 23/025 206/217
D110,691 S * 8/1938 Dudley ..... 206/145
D127,900 S * 6/1941 Block ..... D6/699
2,333,757 A * 11/1943 Whitaker ..... B65D 71/0003 206/199
2,443,116 A * 6/1948 Petyak ..... B65D 71/0003 206/199
2,510,591 A * 6/1950 Listman ..... B65D 71/0003 211/74
2,530,736 A * 11/1950 Sheldon ..... A47G 19/10 126/246
2,684,110 A * 7/1954 Stone ..... A47D 1/0083 297/188.05
2,759,629 A * 8/1956 Sargent ..... A47G 23/0208 206/199
2,935,029 A 5/1960 Miles
2,935,209 A * 5/1960 Fritz ..... A47B 23/04 108/97
3,143,374 A * 8/1964 Corboni ..... A47D 1/008 248/117.7
3,148,636 A * 9/1964 Blomquist ..... B65D 71/72 108/26
D208,317 S * 8/1967 Broder ..... 108/26
4,860,895 A * 8/1989 Iaslovits ..... A47G 23/0633 206/480
4,947,991 A * 8/1990 Snell ..... A47B 13/16 206/427
D342,005 S * 12/1993 Forsberg ..... D8/72
5,558,391 A * 9/1996 Chavous ..... A61G 5/10 297/153
5,641,140 A * 6/1997 Sorenson ..... A47B 13/16 403/267
5,715,953 A * 2/1998 Brown ..... A47F 7/28 211/74
5,871,098 A * 2/1999 Storck ..... B25B 5/08 144/286.5
5,887,940 A * 3/1999 Anderson ..... A47C 7/70 108/157.11
5,893,331 A * 4/1999 Diletto ..... A47C 7/70 297/135
6,193,892 B1 * 2/2001 Krueger ..... B01L 9/06 209/636
6,216,605 B1 * 4/2001 Chapman ..... A47D 15/00 108/26
6,273,503 B1 * 8/2001 Cheng ..... A47D 1/106 297/219.12
6,283,566 B1 * 9/2001 Doces ..... A47G 23/0641 312/351
D493,056 S * 7/2004 Shornak ..... D6/552
6,932,312 B1 * 8/2005 Chen ..... B25B 5/06 248/113
6,984,066 B2 * 1/2006 Borom ..... A61B 6/4441 5/601
7,000,799 B1 * 2/2006 Hamre ..... A47G 19/065 220/575
7,201,440 B2 * 4/2007 Heck ..... A47D 1/008 297/148
D547,048 S * 7/2007 Conway ..... D3/10
7,475,937 B2 1/2009 McGrew et al.
7,562,785 B2 * 7/2009 Meissen ..... B65D 81/36 220/4.28
7,591,401 B2 * 9/2009 Sandler ..... A45F 3/14 248/225.11
7,740,312 B2 * 6/2010 Johnson, Jr. ..... A47B 83/02 297/217.6
D642,039 S * 7/2011 Forsberg ..... D8/72
7,992,714 B1 * 8/2011 Devault ..... A47G 19/10 108/26
8,186,524 B2 * 5/2012 Siahpush ..... A47F 7/283 211/133.4
8,439,200 B1 * 5/2013 Sorrells ..... A47G 23/06 206/559
8,468,958 B2 6/2013 Giabanis
8,820,548 B2 * 9/2014 Wilson ..... A47B 13/14 248/229.15
9,039,079 B2 * 5/2015 Huntsberger ..... A47D 1/0085 206/561
9,089,208 B2 * 7/2015 Zimmerman ..... A47B 23/02
9,132,932 B2 * 9/2015 Scharfe ..... A47G 19/02
9,144,321 B2 * 9/2015 Melo ..... A47G 11/004
9,161,618 B2 * 10/2015 Wilson ..... A47B 13/14
9,220,337 B1 * 12/2015 Wenzel ..... A47B 13/023
9,326,626 B2 * 5/2016 Chein ..... B65D 21/0209
9,615,722 B2 * 4/2017 Mesa ..... A47L 15/50
9,655,462 B2 5/2017 Cook et al.
9,839,311 B2 * 12/2017 Shames ..... A47G 19/065
9,877,586 B2 * 1/2018 Haenga ..... A47G 23/0225
9,926,954 B2 3/2018 Sortino et al.
D817,728 S * 5/2018 Brown ..... D7/701
9,980,589 B2 * 5/2018 Piccinini ..... A47G 19/065
10,052,012 B2 8/2018 Mesa
10,064,510 B1 * 9/2018 Yablon ..... A47G 23/0208
10,165,927 B2 * 1/2019 Mesa ..... A47L 15/503
D870,982 S * 12/2019 Tsai ..... D30/129
D880,787 S * 4/2020 Price ..... D30/121
D880,964 S * 4/2020 Wang ..... D7/701
D883,046 S * 5/2020 Chen ..... D7/552.2
D888,507 S * 6/2020 Floco ..... D7/629
10,709,235 B1 * 7/2020 Brown ..... A47B 5/04
D895,371 S * 9/2020 Brown ..... D7/554.2
D906,068 S * 12/2020 Yang ..... D7/701
D906,773 S * 1/2021 Chen ..... D7/701
D907,450 S * 1/2021 Yang ..... D7/708
D911,759 S * 3/2021 Repp ..... D6/692.4
D911,789 S * 3/2021 Wang ..... D7/701
D912,472 S * 3/2021 Repp ..... D7/584
D914,458 S * 3/2021 Lu ..... D7/552.2
D937,056 S * 11/2021 Coogan ..... D7/701
D1,000,916 S * 10/2023 Chen ..... D7/701
12,185,854 B2 * 1/2025 Brown ..... A47G 23/0641
2005/0017134 A1 * 1/2005 Hooper ..... A47G 23/0241 248/103
2006/0006181 A1 * 1/2006 Rich ..... A47G 19/10 220/574
2006/0113263 A1 * 6/2006 Kratochvil ..... A47G 23/0208 211/85.29
2008/0067840 A1 * 3/2008 McGrew ..... A47G 19/10 297/153
2008/0114463 A1 * 5/2008 Auger ..... A61F 2/3868 623/20.33
2008/0128579 A1 * 6/2008 Chen ..... G06F 1/187
2008/0149580 A1 * 6/2008 Hill ..... A47D 1/0085 211/126.1
2008/0264822 A1 * 10/2008 Faiola ..... A47G 23/0641 206/557
2010/0154683 A1 * 6/2010 Royka ..... A47G 21/167 248/346.03
2010/0176139 A1 * 7/2010 Nargi ..... B60N 3/10 220/737
2010/0209662 A1 * 8/2010 Slade ..... A47G 23/02 428/131
2011/0132914 A1 * 6/2011 Vernes ..... A47G 19/06 206/217
2011/0185951 A1 * 8/2011 Aguayo ..... A47B 23/002 108/43
2012/0097683 A1 * 4/2012 Giabanis ..... A47G 19/10 220/574
2014/0209769 A1 * 7/2014 DeWald ..... A47G 23/02 248/346.03
2014/0263365 A1 * 9/2014 Tollen ..... A47G 19/065 220/575
2016/0056431 A1 * 2/2016 Subramanian ..... H01M 50/262 429/149
2017/0071383 A1 * 3/2017 Cook ..... A47G 23/0208

(56) References Cited

U.S. PATENT DOCUMENTS

| | | | | |
|---|---|---|---|---|
| 2017/0086603 | A1* | 3/2017 | Sortino | F16B 1/00 |
| 2017/0135553 | A1* | 5/2017 | Mesa | A47L 15/50 |
| 2018/0192853 | A1* | 7/2018 | Eilmus | A47B 73/002 |

OTHER PUBLICATIONS

U.S. Pat. No. 126,374 to George G. Bonington, issued May 7, 1872.
U.S. Pat. No. 402,788 to C.L. Wagandt, issued May 7, 1889.

* cited by examiner

BEVERAGE TRAY AND RETAINER

CROSS-REFERENCES TO RELATED APPLICATIONS

This application is a divisional of, and claims the priority benefit of, U.S. patent application Ser. No. 17/738,853, filed May 6, 2022, which claims the priority benefit of, U.S. patent application Ser. No. 16/584,303, filed Sep. 26, 2019 (now U.S. Pat. No. 11,350,779), the contents of which are incorporated herein by reference in their entirety.

TECHNICAL FIELD OF THE INVENTION

The present invention relates generally to portable trays and retainers for holding containers. More particularly, the present invention relates to a portable trays with retainers for holding glasses and other containers for liquid.

BACKGROUND OF THE INVENTION

Tables are often used in recreation and marine vehicles, as well as in homes, restaurants, etc. It is preferable to bring beverages and food onto or into the vehicles, or move beverages and food around or in and out of homes, restaurants, etc., and place them on a table. Tables often have cup holders. However, current tables are usually permanently installed and not easily transportable.

SUMMARY OF THE INVENTION

The present invention broadly relates to retainers that can be incorporated into trays, tables, and storage compartments to securely holding glasses and other containers for beverages and other liquids. For example, a retainer portion with a retainer that is adapted to flex to receive a portion of a glass or other container for a beverage or other liquid may be incorporated into the trays, tables, and storage compartments. The flexing of the retainer also applies a gripping friction force to securely hold the glass or other container. This allows a tray for example, to be easily transported to and from a desired area without the risk of the glass or other container falling out or off of the tray. When used in a recreation or marine vehicle, such as a boat, the retainer portion also allows the glass or other container to be securely held, and minimizes the risk of the glass or other container falling due to movement or rocking of the vehicle.

The present invention also relates to portable trays that can be disposed on and coupled to tables. For example, the tray may include a locking mechanism that releasably couples the tray to the table. The tray may also include side rails that extend over, and optionally frictionally engage, a side of the table to minimize movement of the tray with respect to the table. When used in a recreation or marine vehicle, such as a boat, the side rails and/or the locking mechanism allows the tray to be securely held on the table, and minimizes the risk of the tray falling or sliding off of the table due to movement or rocking of the vehicle.

In an embodiment, the present invention broadly includes a retainer for a beverage container with a stem. The retainer includes a base portion, a recess formed in the base portion, a retainer cap coupled to the base portion and covering the recess, and a flexible retainer disposed in the recess, between the base portion and the retainer cap. The flexible retainer is adapted to hold the stem.

In another embodiment, the present invention broadly includes a tray adapted to be disposed on a table with a retaining rail. The tray includes a first portion that is adapted to be removably received by the retaining rail of the table, and a second portion disposed vertically above and coupled to the first portion. A first slot is formed in the second portion, and a retainer is coupled to the second portion. The retainer includes a retainer slot that is substantially aligned with the first slot, and adapted to receive and retain a stem of a beverage container.

In another embodiment, the present invention broadly includes a tray adapted to be disposed on a table with an aperture. The tray includes a base portion having a bottom surface, and a locking mechanism coupled to the bottom surface. The locking mechanism is adapted to be disposed in the aperture of the table when the tray is disposed on the table, and the locking mechanism is movable between locked and unlocked positions.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
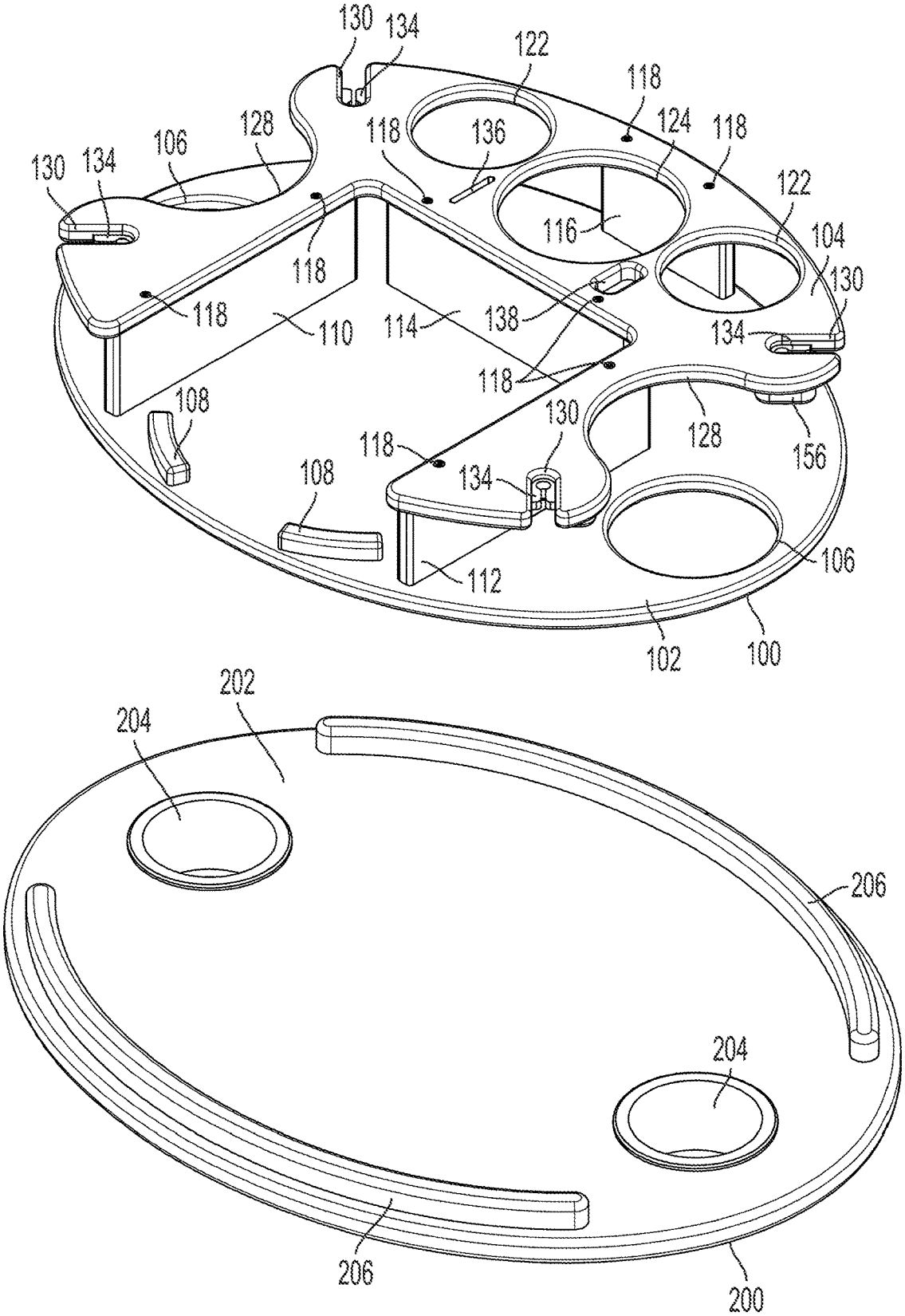
FIG. 1 is a perspective exploded view of a tray and table according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to retainers that can be incorporated into trays, tables, and storage compartments to securely holding glasses and other containers for beverages and other liquids. For example, a retainer portion with a retainer that is adapted to flex to receive a portion of a glass or other container for a beverage or other liquid may be incorporated into the trays, tables, and storage compartments. The flexing of the retainer also applies a gripping friction force to securely hold the glass or other container. This allows a tray, for example, to be easily transported to and from a desired area without the risk of the glass or other container falling out or off of the tray. In an example, when used in a recreation or marine vehicle, such as a boat, the retainer portion also allows the glass or other container to be securely held, and minimizes the risk of the glass or other container falling due to movement or rocking of the vehicle.

The present invention also relates to portable trays that can be disposed on and coupled to tables. For example, the tray may include side rails that extend over, and optionally frictionally engage, a side of the table to minimize movement of the tray with respect to the table. The tray may also include a locking mechanism that releasably couples the tray to the table. When used in a recreation or marine vehicle, such as a boat, the locking mechanism allows the tray to be securely held on the table, and minimizes the risk of the tray falling or sliding off of the table due to movement or rocking of the vehicle.

In an embodiment, a retainer mechanism is disclosed that can be incorporated into a tray, table, storage compartment (such as a cabinet, chiller, etc.). The retainer mechanism includes a base portion with a slot, and a retainer recess formed in a bottom or under side of the base portion proximal to the slot. A retainer is disposed in the recess and held in place by a retaining cap.

The recess is adapted to receive the retainer, and includes relief portions that extend outwardly at an angle. The relief portions allow the retainer to flex outwardly into the relief portions as a stem of a wine glass is pushed into the slot, for example, and then flex back inwardly to grip and hold the stem of the wine glass. The retainer may be made of any flexible material that allows for the flexing of the retainer, such as a flexible polymer, rubber, etc. The retainer includes a retainer body with a retainer slot that forms opposing first and second finger like portions, and a retainer hole disposed in the back or interior of the slot. The retainer slot can have a width that is smaller than the diameter of the retainer hole and that is smaller than the stem of the wine glass.

When the stem of the wine glass is inserted into the slot and the retainer slot, the finger like portions of the retainer flex outwardly, away from one another, into the corresponding relief portions, thereby causing a width of the retainer slot to be enlarged. The widening of the retainer slot allows the stem of the wine glass to proceed through the retainer slot to the retainer hole without compressing the retainer, which both increases ease of use and useful lifecycle of the retainer.

Figure 2:
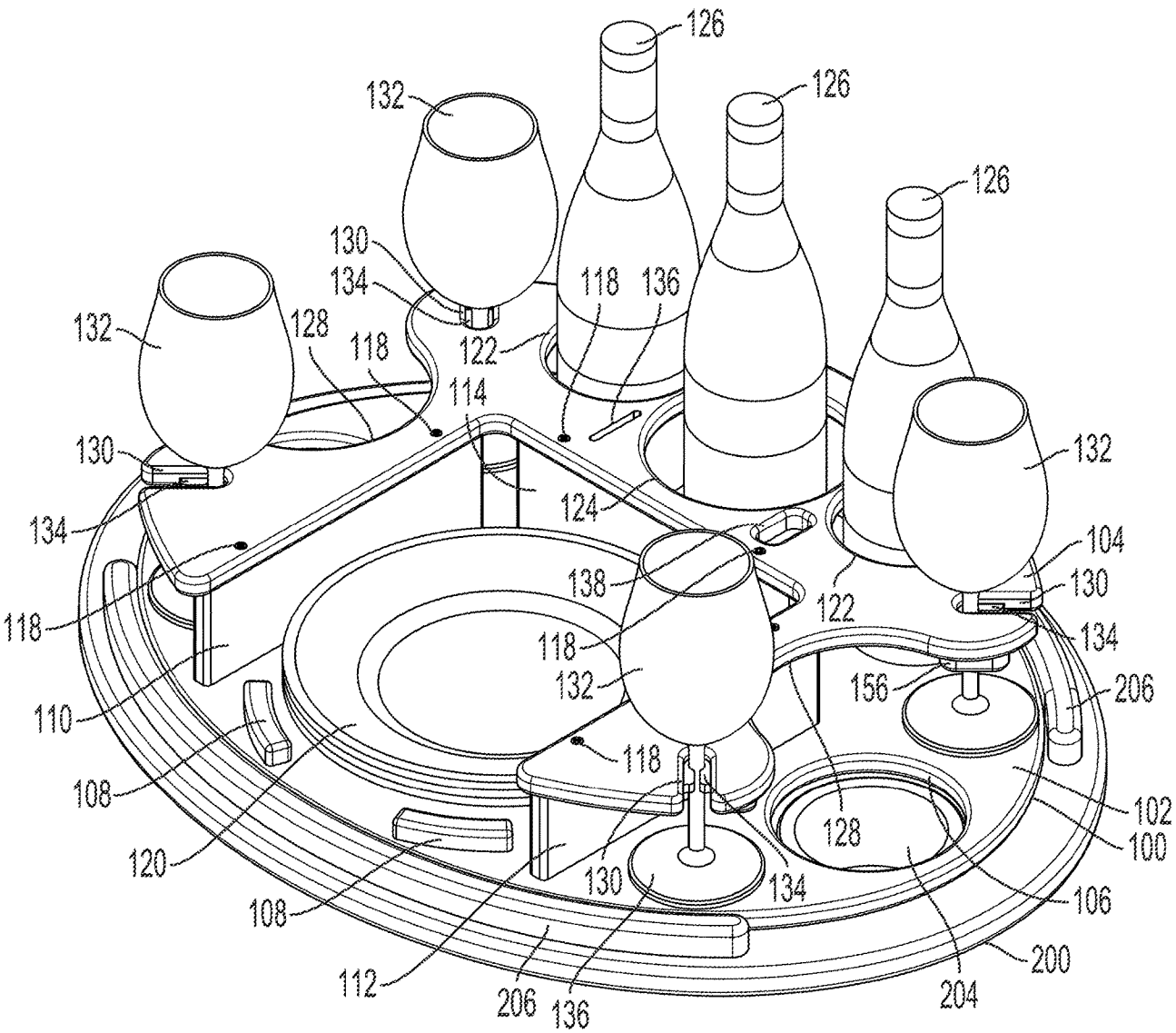
FIG. 2 is a perspective view of the tray and table of FIG. 1.
Figure 3:
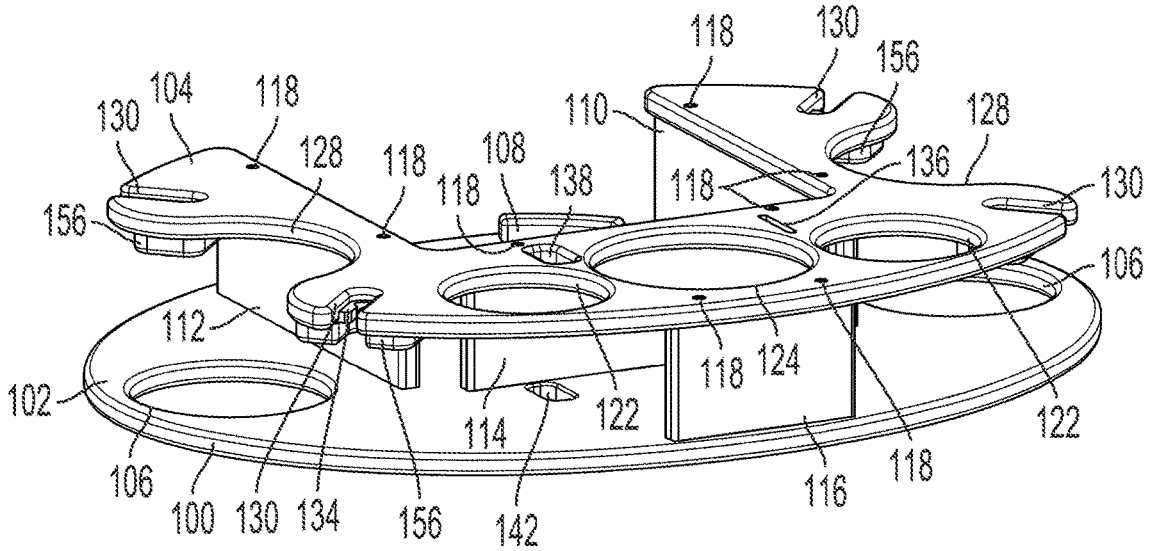
FIG. 3 is first rear perspective view of the tray of FIG. 1.
Figure 4:
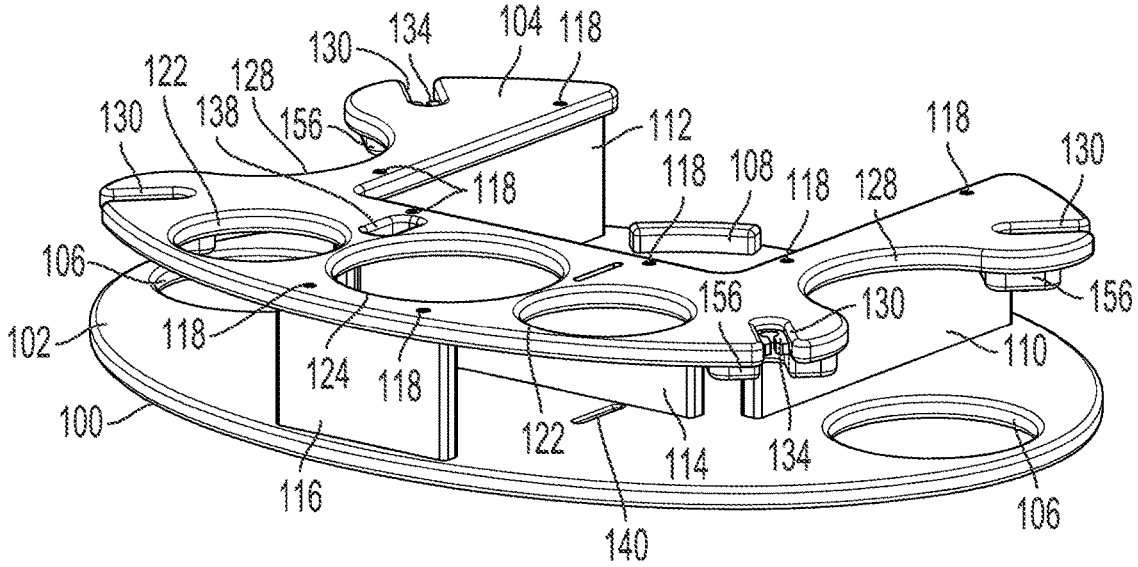
FIG. 4 is second rear perspective view of the tray of FIG. 1.
Figure 5:
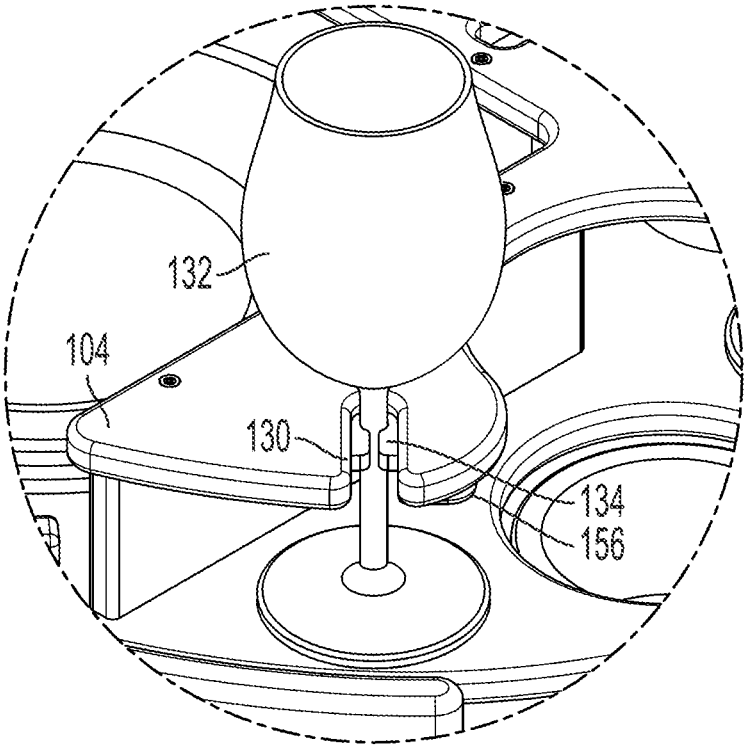
FIG. 5 is an enlarged detail perspective view of a retainer portion of the tray of FIG. 1.

Referring to FIGS. 1 and 2, a tray 100, such as a transportable serving tray incorporating the retainer, and a table 200 are illustrated. The table 200 may be installed (removably or non-removably) in a recreation or marine vehicle using known methods. The table 200 includes a substantially flat base portion 202, beverage or cup holders 204, and retaining rails 206. Although FIGS. 1 and 2 illustrate the table 200 as an ellipse type shape, the table 200 can be various sizes and shapes without departing from the spirit and scope of the present invention. For example, the table 200 may have a square, circular, triangular, or other polygonal or geometric shape.

The cup holders 204 may be recessed into corresponding apertures of the base portion 202, and made of various shapes and sizes. In this example, there are two cup holders 204 that are circular and are disposed proximal to opposing ends of the base portion 202. However, there may be more or less than two cup holders 204, and the cup holders 204 may be located anywhere on the base portion 202.

Figure 9:
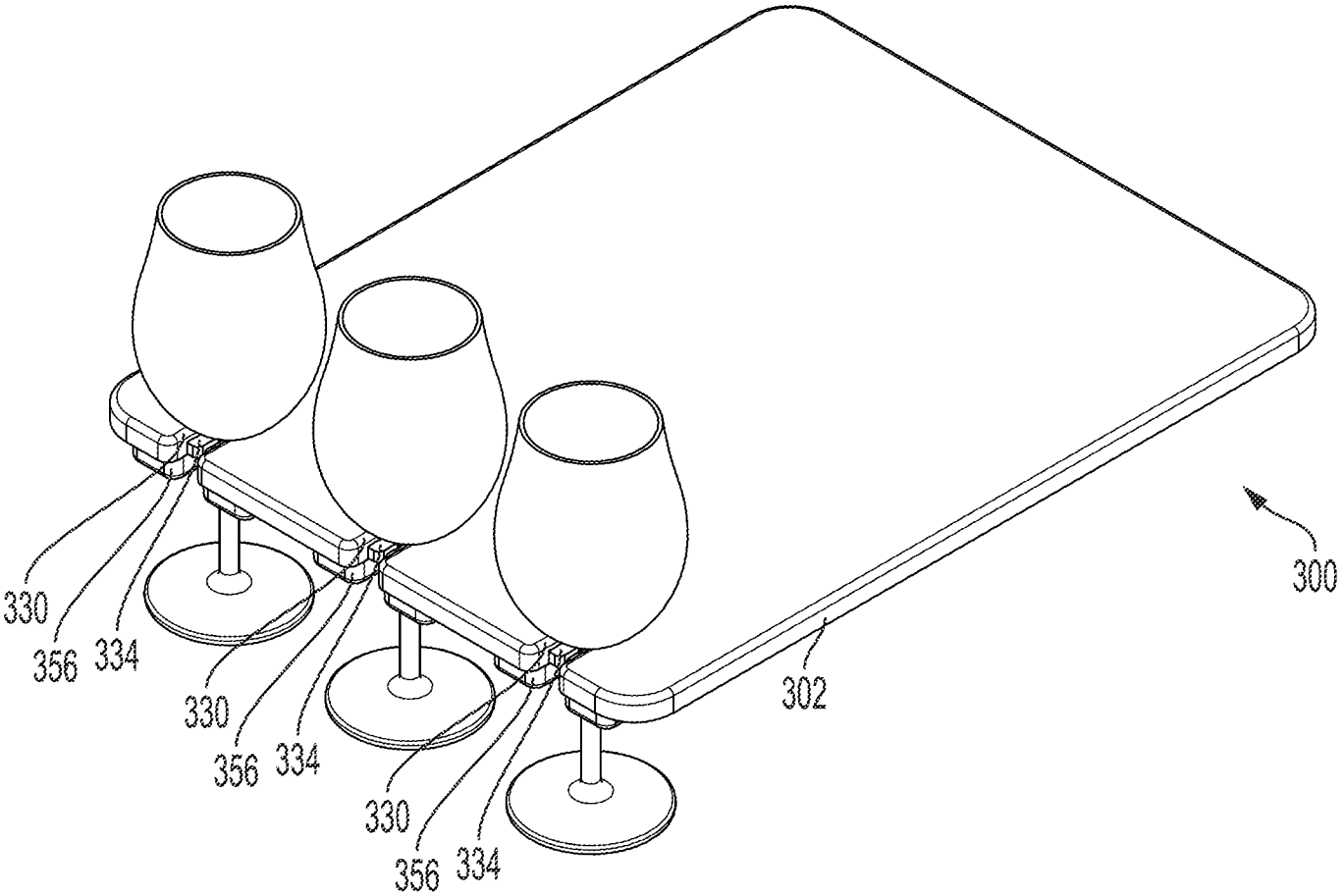
FIG. 9 is a perspective view of a table according to an embodiment of the present invention.
Figure 12:
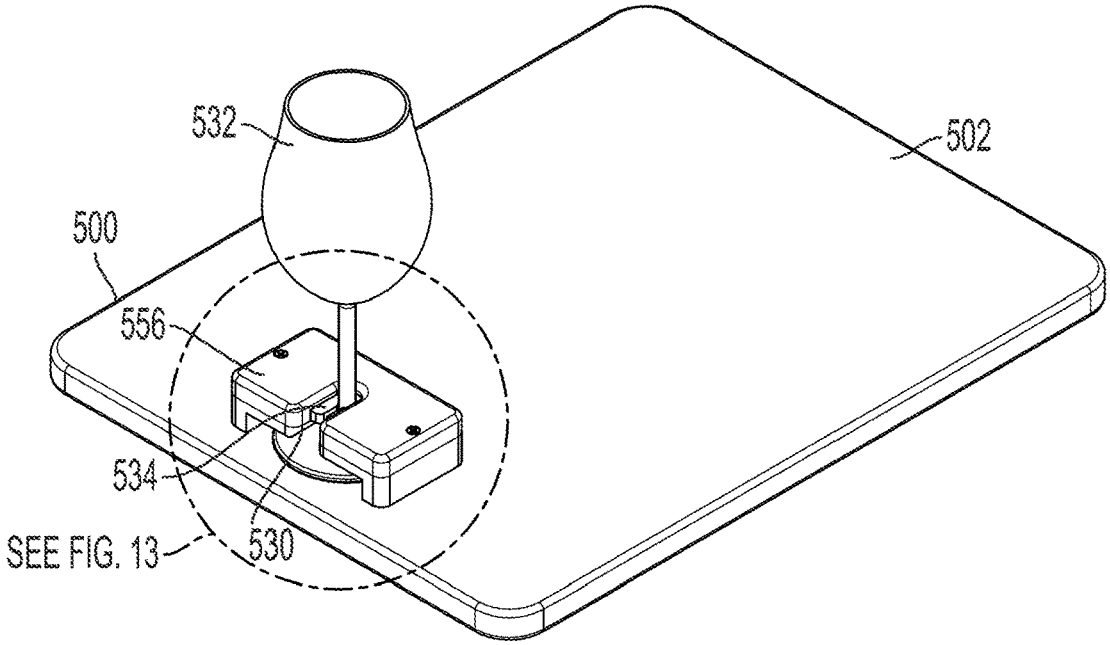
FIG. 12 is a perspective view of a table according to an embodiment of the present invention.
Figure 13:
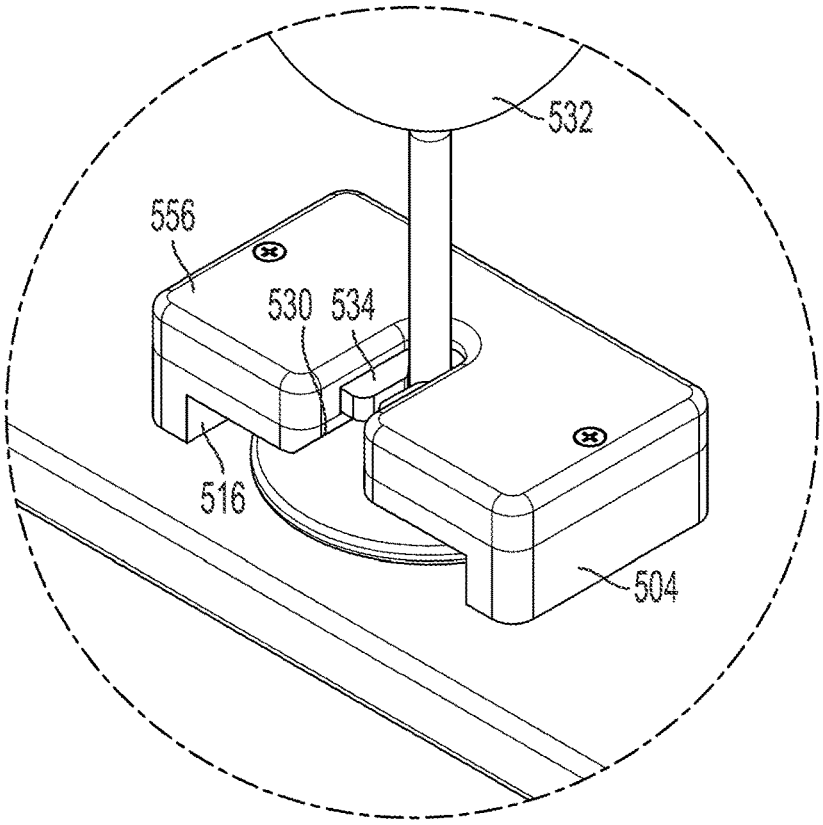
FIG. 13 is an enlarged perspective view of a retainer portion of the table of FIG. 12.

The retaining rails 206 are formed on or coupled to the base portion 202, and extend in an upwardly direction from the base portion 202. The retaining rails 206 are adapted to retain the tray 100 on the base portion 202, when the tray 100 is disposed on the table 200. For example, the tray 100 can be placed on the table 200 and fit between two retaining rails 206, as shown in FIG. 2. The two retaining rails 206 can, therefore, prevent the tray 100 from sliding off the table 200 during movement of the recreation or marine vehicle. As illustrated, the retaining rails 206 are disposed proximal to opposing side ends of the base portion 202. However, other arrangements regarding retaining rails 206 may be used, such as a single or multiple retaining rails 206. In addition, the table 200 can have a recess formed (not shown) to prevent the tray 100 from sliding. The table 200 may also include a retainer that is adapted to hold or retain a wine glass stem, as shown in FIGS. 9, 12, and 13, which is discussed in greater detail below.

Referring also to FIGS. 1-5, the tray 100 includes a base portion or first portion 102 and a second portion 104 (which may also be referred to as a second base portion) disposed vertically above and spaced from the first portion 102. The first portion 102 may be substantially flat, and sized and a shaped to fit within the retaining rails 206 of the table 200. However, other structures can be implemented as the first portion 102 without departing from the spirit and scope of the present invention.

The first portion 102 may include cup holder apertures 106 that correspond to the number, size, and location of the cup holders 204 of the table 200. The cup holder apertures 106 are adapted to align with the cup holders 204 and allow for the cup holders 204 of the table 200 to be usable when the tray 100 is disposed on the table 200. The cup holder apertures 106 can also be sized to allow for removal and/or engagement of the tray 100 with the table 200 while the cup holders 204 are in use.

One or more retaining rails or protrusions 108 are formed on or coupled to the first portion 102, and extend in an upwardly direction from the first portion 102. The retaining rails 108 are adapted to retain an article, such as a plate or other article, disposed on the first portion 102, and/or prevent the article from sliding off the first portion 102 during movement of the recreation or marine vehicle. As illustrated, there are two retaining rails 108 disposed proximal to a side end of the first portion 102. However, other arrangements regarding retaining rails 108 may be used, such as a single or multiple retaining rails 108.

The second portion 104 may be coupled to the first portion 102, and have a size and a shape that corresponds with the first portion 102. However, other structures can be implemented as the second portion 104 without departing from the spirit and scope of the present invention. In an example, the second portion 104 is coupled to the first portion 102 by first, second, third, and fourth supports 110, 112, 114, 116. A first end of each of the supports 110, 112, 114, 116 is coupled to the first portion 102, and the supports 110, 112, 114, 116 extend vertically upward from the first portion 102 to a second end of the supports 110, 112, 114, 116. The second portion 104 is coupled to the second ends of the supports 110, 112, 114, 116. The supports 110, 112, 114, 116 cause the second portion 104 to be coupled to the first portion 102, with the second portion 104 being vertically spaced from the first portion 102 at a distance. In this example, the supports 110, 112, 114, 116 are coupled to the first and second portions 102, 104 via fasteners 118. However, other coupling methods known in the art and/or more or less support plates can be used without departing from the spirit and scope of the present invention.

The first, second and third supports 110, 112, and 114, may be arranged to provide an area to carry and article, such as dishware 120. In this example, the first, second and third supports 110, 112, and 114 work with the one or more retaining rails 108 of the first portion 102 to carry dishware 120.

The second portion 104 may have a number of first and second apertures 122, 124 adapted to hold bottles or other containers. In this example, one second aperture 124, larger than the first aperture 122, and two first apertures 122 are used to hold wine bottles 126. However, any number and combination of apertures may be used without departing from the spirit and scope of the present invention.

The second portion 104 may also have a cutout or contoured surface 128 that corresponds with the cup holders 204 of the table 200. The contoured surface 128 allows the cup holders 204 to be used without interference by the second portion 104. In addition, the contoured surface(s) 128 can act as a handle for holding and carrying the tray 100.

The second portion 104 may include one or more slots 130 adapted to receive a stem of a wine glass, for example. The slots 130 can be sized to allow a stem of a wine glass to pass through to hold a wine glass 132, as shown by dimension d in FIG. 8. For example, the wine glass 132 may be held in the slot 130, with a foot or base of the wine glass 132 resting on the first portion 102 and the stem disposed in the slot 130. As illustrated, the second portion 104 includes four slots 130 spaced apart around the second portion 104. However, the second portion 104 may include more or less than four slots 130 positioned in any number of various locations around the second portion 104. In addition, a retainer 134 can also be coupled to the second portion 104 to more securely hold the stem of the wine glass, which is discussed in greater detail below.

The second portion 104 may also include one or more additional slots or apertures 136 and 138 that are each adapted to receive and hold an article, such as a knife, a corkscrew, a bottle opener, eating utensils, etc. The first portion 102 may also include corresponding recesses 140 and 142 that are respectively aligned with the apertures 136 and 138 to assist in retaining the article in the respective apertures 136 and 138.

Figure 6:
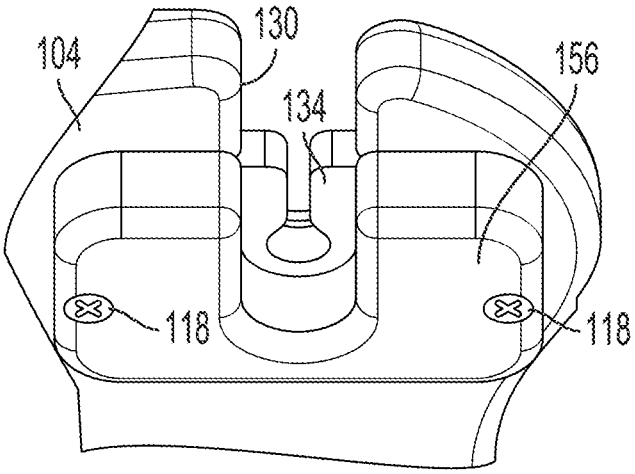
FIG. 6 is a bottom perspective view of the retainer portion of FIG. 5.
Figure 7:
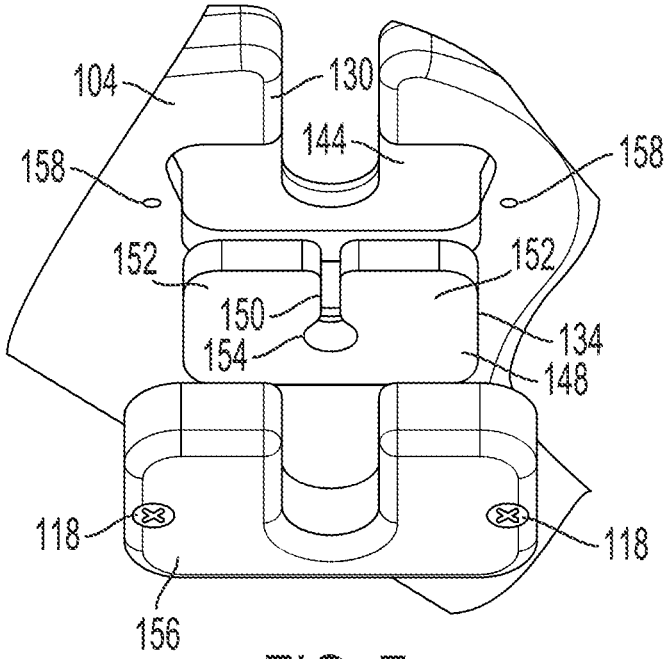
FIG. 7 is a bottom, perspective, exploded view of the retainer portion of FIG. 6.
Figure 8:
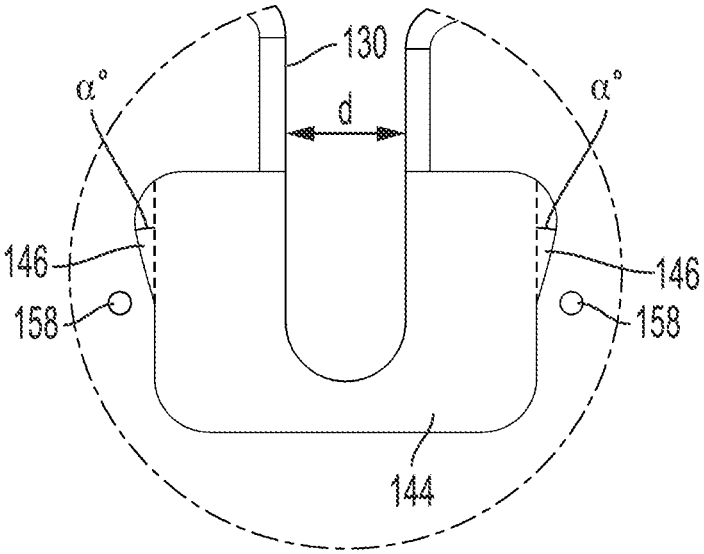
FIG. 8 is a bottom, elevation view of a retainer recess of FIG. 7.

Referring to FIGS. 6-8, a retainer portion of the tray 100 is illustrated and described in greater detail. The retainer portion includes a retainer recess 144 formed in a bottom or under side of the second portion 104 proximal to the slot 130. In this example, the retainer recess 144 is about ¼" in depth and has a generally rectangular profile that corresponds to slot 130. However, other profiles and dimensions can be implemented without departing from the spirit and scope of the present invention.

The recess 144 is adapted to receive the retainer 134, and includes relief portions 146 that each have an angle $\alpha$. The relief portions 146 allow the retainer 134 to flex outwardly into the relief portions 146 as a stem of a wine glass is pushed into the slot 130, and then flex back inwardly to grip and hold the stem of the wine glass. In an example, the angle $\alpha$ is about 15°. However, other angles can be used without departing from the spirit and scope of the present invention.

The retainer 134 may be made of any flexible material that allows for the flexing of the retainer 134, such as a flexible polymer, rubber, etc. As illustrated in FIG. 7, the retainer 134 includes a retainer body 148 with a retainer slot 150 that forms opposing first and second finger like portions 152, and a retainer hole 154 (widened portion of the back of the slot 130) disposed in the back or interior of the slot 130. The retainer slot 150 can have a width that is smaller than the diameter of the retainer hole 154 and that is smaller than the stem of the wine glass 132. In this example, the width is about ⅛". However, other dimensions can be used without departing from the spirit and scope of the present invention.

The retainer 134 is disposed in the recess 144, and is held in place by a retaining cap 156. The retaining cap 156 is sized and shaped to correspond to and cover the retainer 134 and recess 144. In this example, the cap 156 is a rectangular shape that is slightly larger than the retainer 134 and recess 144 and has a slot corresponding to the slot 130. The retaining cap 156 can be coupled to the second portion 104, using fasteners 118. In this example, the fasteners 118 are threaded fasteners that engage with tapped holes 158 in the second portion 104. However, other fasteners and methods of coupling or holding the retainer 134 in place can be used without departing from the spirit and scope of the present invention.

In another embodiment, the recess 144 may be disposed or formed in the retaining cap 156 instead of the bottom or under side of the second portion 104. The recess 144 may also be disposed in or formed by a combination of both of the retaining cap 156 and the bottom or under side of the second portion 104.

When the stem of the wine glass 132 is inserted into the slot 130 and the retainer slot 150, the finger like portions 152 of the retainer 134 flex outwardly, away from one another, into the corresponding relief portions 146, thereby causing a width of the retainer slot 150 to be enlarged. The widening of the retainer slot 150 allows the stem of the wine glass 132 to proceed through the retainer slot 150 to the retainer hole 154 without compressing the retainer 134, which both increases ease of use and useful lifecycle of the retainer 134. In this example, the retainer hole 154 has a diameter that is approximately the same size of the stem of the wine glass 132. In this example the diameter is about ⅜". However, other diameters can be used without departing from the spirit and scope of the present invention.

In another embodiment, one or more retainers can be used in and incorporated in a table 300, as shown in FIG. 9. For example, the slot 130, recess 144, retainer 134, and retainer cap 156 may be incorporated directly into the table 300. In this example, the table 300 may include a base or first portion 302, with one or more slots 330 (which are substantially similar to the slots 130 described above) incorporated into an edge of the first portion 302. One or more corresponding recesses (which are substantially similar to recesses 144 described above) may also be incorporated into a bottom or underside of the first portion 302. The table 300 also includes one or more corresponding retainers 334 and retainer caps 356 that are substantially similar to the retainers 134 and retainer caps 156 described above. While, three retainer portions are illustrated in FIG. 9, the table 300 can be any shape or size, and include any number of retainer portions without departing from the spirit and scope of the present invention.

Figure 10:
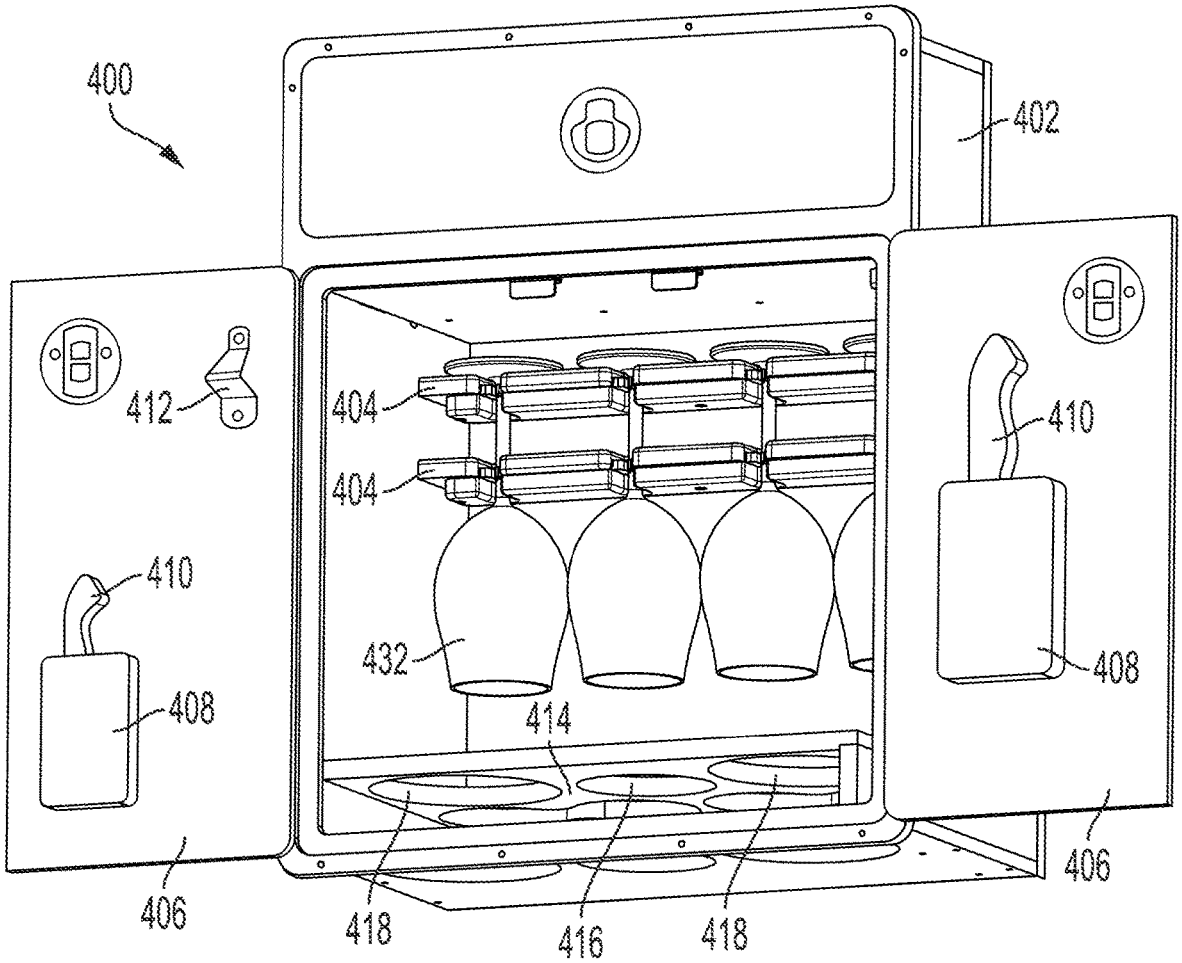
FIG. 10 is a perspective view of a storage compartment according to an embodiment of the present invention.
Figure 11:
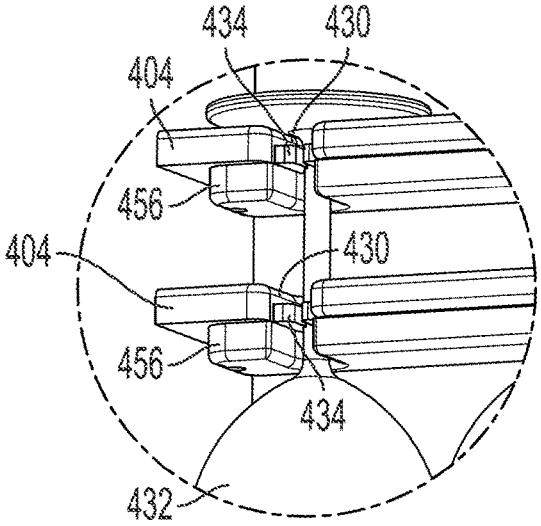
FIG. 11 is an enlarged perspective view of a retainer portion of the storage compartment of FIG. 10.

In another embodiment, the retainer portions (such as slot 130, recess 144, retainer 134, and retainer cap 156) can be incorporated into a storage container 400, as shown in FIGS. 10 and 11. In this example, one or more wine glasses 432 are held by slots 430 in each of two rails 404 that are arranged in series in a body 402 of the storage container 400. Each of the rails 404 includes one or more slots 430 (which are substantially similar to the slots 130 described above) incorporated into an edge of the rail 404. One or more corresponding recesses (which are substantially similar to recesses 144 described above) may also be incorporated into a bottom or underside of the rails 404. The storage container 400 also includes one or more corresponding retainers 434 and retainer caps 456 that are substantially similar to retainers 134 and retainer caps 156 described above, except that the retainer cap 456 may extend along a length of the rail 404 and be used to couple more than one retainer 434 to the rail 404. Alternatively, individual retainer caps can be used as described above. While three retainer portions are illustrated in FIG. 10, the storage container 400 can be any shape or size, and include any number of retainer portions without departing from the spirit and scope of the present invention.

The storage container 400 may include doors 406, each with utensil holders 408 coupled to an interior surface of the door 406 and adapted to hold utensils 410. The storage container 400 may also include a bottle opener 412 and a bottle holder plate 414 with any combination of first and second apertures 416 and 418 that are adapted to hold beverage containers, such as varying sizes of wine bottles.

In another embodiment, the retainer portions (such as slot 130, recess 144, retainer 134, and retainer cap 156) can be incorporated into a surface mount for a base or first portion 502 of a table 500 to hold a stem of a wine glass 532, as shown in FIGS. 12 and 13. In this embodiment, a mounting plate 504 is coupled to a top surface of the first portion 502 of the table 500, for example, using fasteners or other means. The mounting plate 504 may have legs 516 that provide clearance under the mounting plate 504 that allow for a foot or base of the wine glass 532 to be received under the mounting plate 504, between the mounting plate 504 and the first portion 502. The mounting plate 504 includes one or more slots 530 (which are substantially similar to the slots 130 described above) incorporated into an edge of the mounting plate 504. The table 500 also includes one or more corresponding retainers 534 and retainer caps 556 that are substantially similar to retainers 134 and retainer caps 156 described above. However, the corresponding recesses (which is substantially similar to the recesses 144 described above) may be incorporated into a top side of the mounting plate 504 and/or a bottom side of the retainer cap 556. While, one retainer portion is illustrated in FIG. 12, the table 500 can be any shape or size, and include any number of retainer portions without departing from the spirit and scope of the present invention.

In another embodiment, the present invention also relates to portable trays that can be disposed on and coupled or releasably locked to tables. The retainer portions (such as slot 130, recess 144, retainer 134, and retainer cap 156) can be incorporated into these trays. For example, referring to FIGS. 14 and 15, a portable tray 600 includes a base portion or first portion 602 that is sized and a shaped to fit on a table 700 (illustrated in FIGS. 16 and 17). However, the tray 600 may be sized and a shaped to fit on any surface or structure in accordance with the invention.

The tray 600 may also include a locking mechanism 660 disposed on and rotatably coupled to a bottom surface of the first portion 602. The locking mechanism 660 is adapted to be disposed in an aperture of a table and then moved to releasably lock the tray 600 to the table (such as table 700). For example, the table 700 may be the foldable table described in U.S. patent application Ser. No. 16/445,776, filed Jun. 19, 2019, titled Foldable Table, the contents of which are incorporated by reference in their entirety. Accordingly, the table 700 may include a table top 702, a support structure 704, and a mounting structure 706. The table top 702 is rotatably or pivotably coupled to the support structure 704 and the mounting structure 706. The support structure 704 is also rotatably or pivotably coupled to the mounting structure 706, which allows for the table 700 to be moved between the raised and folded positions. The table top 702 may also include one or more beverage holders 708, which may be various shapes and sizes to hold a variety of beverage containers. Further, as described in U.S. patent application Ser. No. 16/445,776, the table 700 may also include a handle 712 formed by an aperture in the table top 702.

Figure 16:
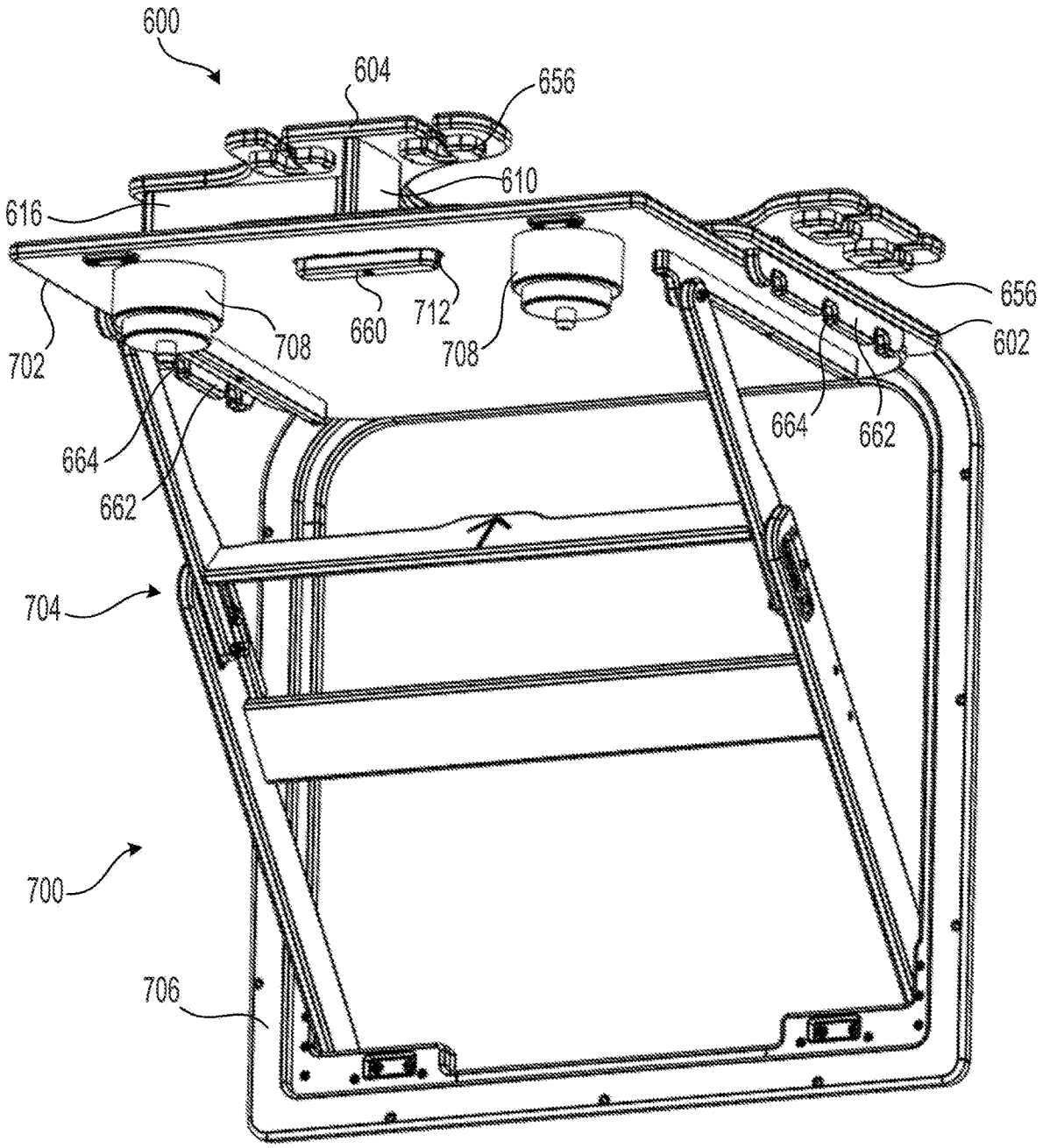
FIG. 16 is a bottom perspective view of the tray of FIG. 14 disposed on a table according to an embodiment of the present invention.
Figure 17:
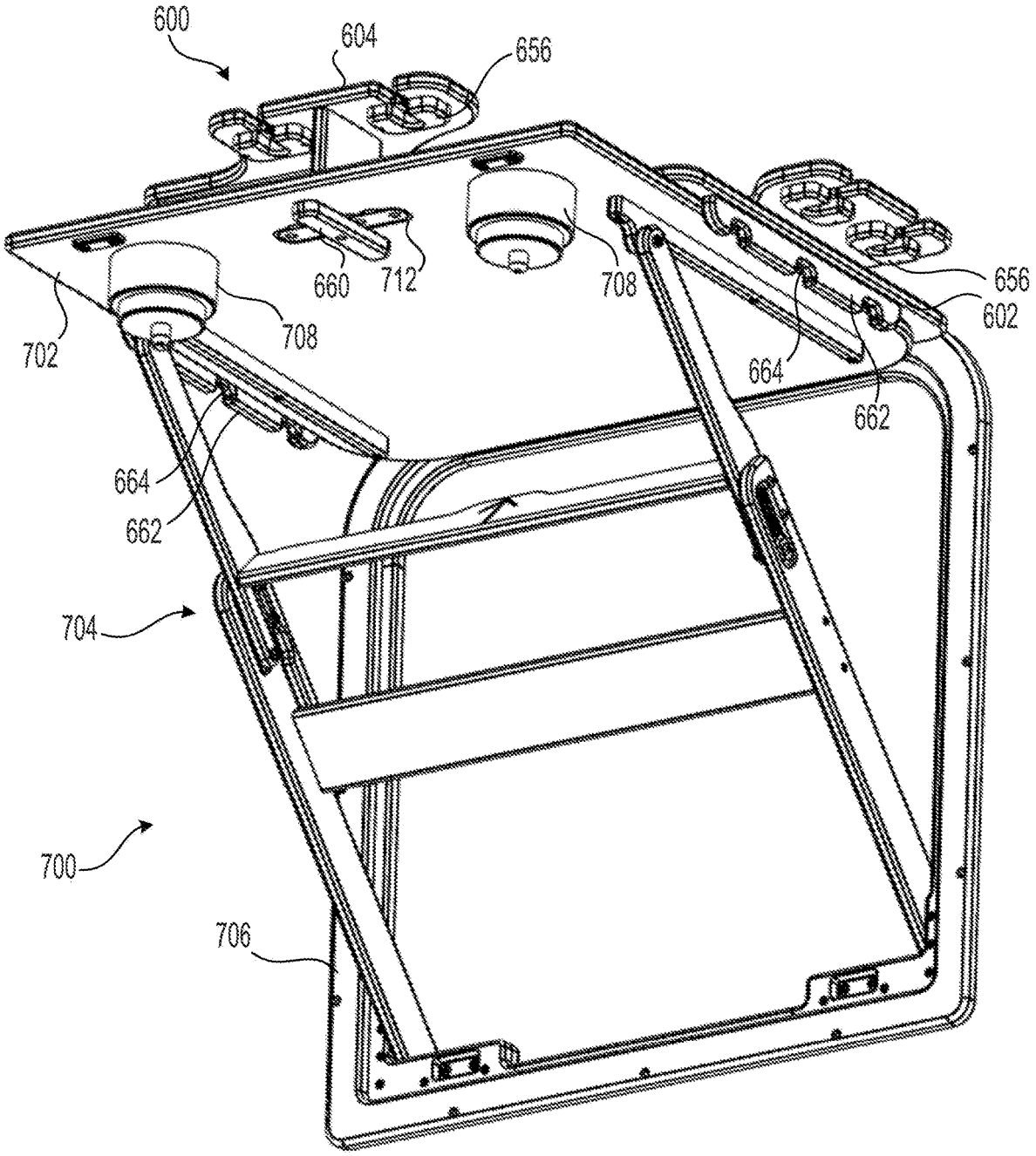
FIG. 17 is a bottom perspective view of the tray of FIG. 14 disposed on the table, and in a locked state according to an embodiment of the present invention.

In this example and referring to FIGS. 16 and 17, the tray 600 may be disposed on the table top 702 with the locking mechanism 660 extending through the handle aperture 712 of the table 700. As illustrated in FIG. 16, the locking mechanism 660 is in an unlocked position, that allows the tray 600 to be disposed on and removed from the table 700. When the tray 600 is disposed on the table top 702 with the locking mechanism 660 extending through the handle aperture 712, the locking mechanism 660 may be moved, by rotation, to a locked position, as illustrated in FIG. 17, to lock the tray 600 to the table 700. In the locked position, the locking mechanism 660 engages a bottom surface of the table top 702 to lock the tray 600 to the table 700. When used in a recreation or marine vehicle, such as a boat, the locking mechanism 660 allows the tray 600 to be securely held on the table 700, and minimizes the risk of the tray 600 falling or sliding off of the table 700 due to movement or rocking of the vehicle.

As illustrated in FIG. 17, the locking mechanism 660 is rotated about 90 degrees. However, rotation of the locking mechanism 660 from about 1-179 degrees would still lock the tray 600 to the table 700.

While the locking mechanism 660 is described as a rotation type of locking mechanism, the locking mechanism 660 can be any other type of locking mechanism that is movable between locked and unlocked positions. For example, the locking mechanism 660 may be a slide bolt type of locking mechanism that engages the bottom surface of the table top 702 to lock the tray 600, when the locking mechanism 660 is disposed in the locked position. The locking mechanism 660 may be a clip type of locking mechanism that engages the bottom surface of the table top 702 to lock the tray 600, when the locking mechanism 660 is disposed in the locked position. The locking mechanism 660 may also be a spring biased latch type of locking mechanism, where the latch is moved against a spring force when the tray 600 is disposed on the table 700, and the latch moves according to the spring force to the locked position in engagement with the bottom surface of the table top 702, when the lock mechanism 660 is disposed through the handle aperture 712.

The tray 600 may also optionally include one or more retaining rails 662 coupled to an extending in a downward direction from the bottom surface of the first portion 602. The retaining rails 662 may also be positioned proximal to edges of the first portion 602. In example, the retaining rails 662 are positioned to extend over, and optionally frictionally engage, a side of a table top (such as table top 702) to minimize movement of the tray 600 with respect to the table (such as table 700). When used in a recreation or marine vehicle, such as a boat, the retaining rails 662 alone, the locking mechanism 660 alone, or the combination of the retaining rails 662 and the locking mechanism 660 allow the tray 600 to be securely held on the table (such as table 700), and minimizes the risk of the tray 600 falling or sliding off of the table (such as table 700) due to movement or rocking of the vehicle.

The retaining rails 662 may also include one or more grooves 664. The grooves 664 may be adapted to engage a structure of a table, assist in the retaining rails 662 acting as legs for the tray 600 when the tray is disposed on a surface or the ground, assist in the retaining rails 662 acting as handle for gripping and carrying the tray 600, and/or engage a storage structure for storing the tray 600. The tray 600 may also include one or more handle apertures 666 to allow for each of gripping and carrying/transportation of the tray 600.

Figure 14:
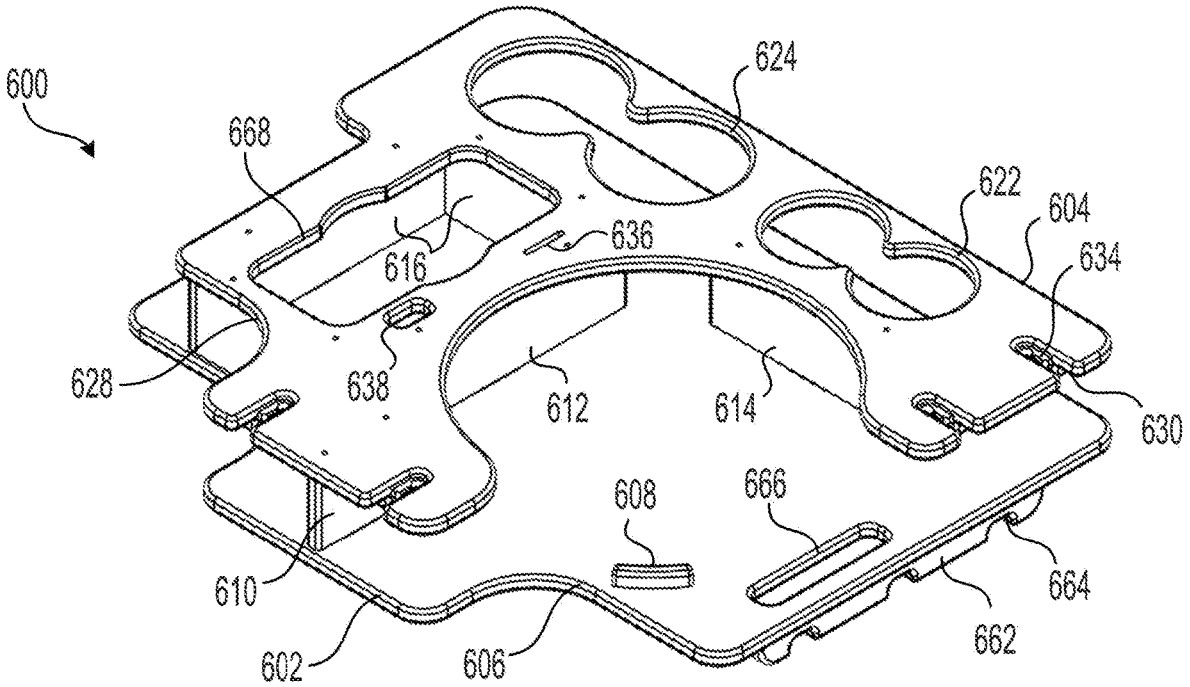
FIG. 14 is a perspective view of another tray according to an embodiment of the present invention.
Figure 15:
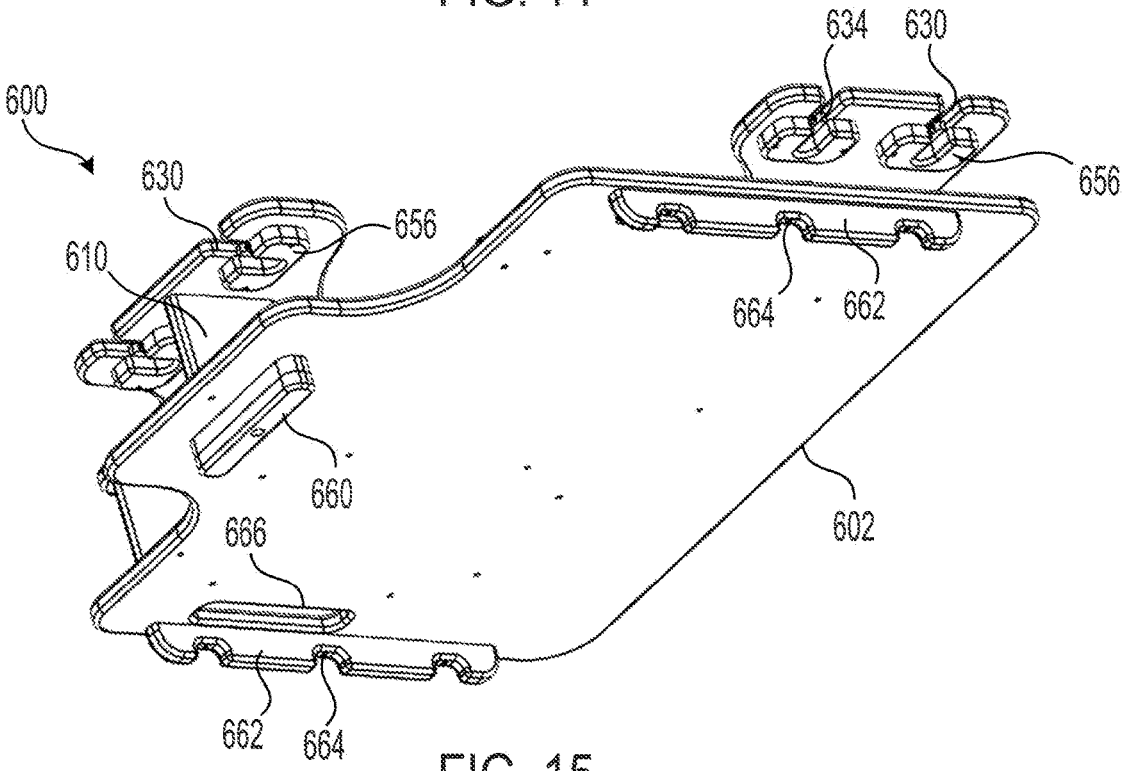
FIG. 15 is a bottom perspective view of the tray of FIG. 14.

Referring to FIGS. 14 and 15, the tray 600 may also include one or more of the features of the tray 100 described above. For example, the tray 600 may include a second portion 604 (which may also be referred to as a second base portion) disposed vertically above and spaced from the first portion 602. As described above with respect to the first portion 102, the first portion 602 may be substantially flat, and sized and a shaped to fit on the table 700. For example, the first portion 602 may include cutouts (such as cup holder cutouts 606 similar to cup holder apertures 106) that allow access to beverage holders 708 of the table 700. However, other structures, sizes, and shapes can be implemented as the first portion 602 without departing from the spirit and scope of the present invention. The first portion 602 may also include one or more retaining rails or protrusions 608 (similar to retaining rails or protrusions 108) formed on or coupled to the first portion 602, and that extend in an upwardly direction from the first portion 602.

The second portion 604 may be coupled to the first portion 602, and have a size and a shape that corresponds with the first portion 602. However, other structures can be implemented as the second portion 604 without departing from the spirit and scope of the present invention. In an example, the second portion 604 is coupled to the first portion 602 by one or more supports, such as first, second, third, and fourth supports 610, 612, 614, 616 (as described above with respect to supports 110, 112, 114, 116). The supports 610, 612, 614, 616 cause the second portion 604 to be coupled to the first portion 602, with the second portion 604 being vertically spaced from the first portion 602 at a distance. One or more of the supports 610, 612, 614, 616, may be arranged to provide an area to carry and article, such as dishware. In this example, the supports 612 and 614 work with the one or more retaining rails 608 of the first portion 602 to carry dishware or other articles. The supports 616 may also form an area 668 for storing and carrying articles.

The second portion 604 may have a number of first and second apertures 622, 624 adapted to hold bottles or other containers. In this example, two second apertures 624, larger than two first apertures 622. However, any number and combination of apertures may be used without departing from the spirit and scope of the present invention.

The second portion 604 may also have a cutout or contoured surface 628 that corresponds with the beverage holders 708 of the table 700, and allow the beverage holders 708 to be used without interference by the second portion 604.

The second portion 604 may also include a retainer portion. For example, the second portion 604 may include one or more slots 630 adapted to receive a stem of a wine glass, for example. The slots 630 can be sized to allow a stem of a wine glass to pass through to hold a wine glass, as shown as described above with respect to tray 100. As illustrated, the second portion 604 includes four slots 630 spaced apart around the second portion 604. However, the second portion 604 may include more or less than four slots 630 positioned in any number of various locations around the second portion 604.

The second portion 604 may also include one or more additional slots or apertures 636 and 638 that are each adapted to receive and hold an article, such as a knife, a corkscrew, a bottle opener, eating utensils, etc. The first portion 602 may also include corresponding recesses (similar to recess 140 and 142).

The tray 600 may also include a retainer portion. The retainer portion includes a retainer recess (similar to the recess 144) formed in a bottom or under side of the second portion 604 proximal to the slot 630. The recess is adapted to receive a retainer 634 (similar to the retainer 134), and includes relief portions (such as relief portions 146) that each have an angle $\alpha$. The relief portions allow the retainer 634 to flex outwardly into the relief portions as a stem of a wine glass is pushed into the slot 630, and then flex back inwardly to grip and hold the stem of the wine glass. In an example, the angle $\alpha$ is about 15°. However, other angles can be used without departing from the spirit and scope of the present invention.

The retainer 634 may be made of any flexible material that allows for the flexing of the retainer 634, such as a flexible polymer, rubber, etc. As described above with respect to tray 100, the retainer 634 includes a retainer body (such as body 148) with a retainer slot (such as slot 150) that forms opposing first and second finger like portions (such as portions 152), and a retainer hole (such as hole 154, relating to a widened portion of the back of the slot 630) disposed in the back or interior of the slot 630.

The retainer 634 is disposed in the recess, and is held in place by a retaining cap 656 (similar to cap 156). The retaining cap 656 is sized and shaped to correspond to and cover the retainer 634 and recess. When the stem of the wine glass is inserted into the slot 630 and the retainer slot, the finger like portions of the retainer 634 flex outwardly, away from one another, into the corresponding relief portions, thereby causing a width of the retainer slot to be enlarged. The widening of the retainer slot allows the stem of the wine glass to proceed through the retainer slot to the retainer hole without compressing the retainer 634, which both increases ease of use and useful lifecycle of the retainer 634.

It should be appreciated that the trays, tables, storage cabinets, and other structures described herein may be sized and shaped according to any particular application or need. Any of the trays, tables, storage cabinets, and other structures described herein may also incorporate any number of the various features described here to provide trays, tables, storage cabinets, and other structures having the desired features for a particular application.

It will be appreciated that while the present invention is described as being applicable for a table used in a recreational or marine vehicle, such description is exemplar, and the invention is not limited to such uses. The present invention can be utilized in any type of environment where a table may be used.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A retainer for a beverage container with a stem, comprising:

a base portion;

a recess formed in the base portion, wherein the recess includes a relief portion disposed at an angle of about 15 degrees;

a retainer cap coupled to the base portion and covering the recess; and a flexible retainer disposed in the recess between the base portion and the retainer cap and adapted to hold the stem, wherein the flexible retainer includes a retainer slot that forms opposing finger like portions that are adapted to flex outwardly away from one another and into the relief portion when the stem is pushed into the retainer slot.

2. The retainer of claim 1, wherein the base portion is part of a table, a tray, or a storage container.

3. The retainer of claim 1, wherein the flexible retainer is made of a flexible material.

4. The retainer of claim 1, wherein the base portion includes a first slot adapted to receive the stem.

5. The retainer of claim 4, wherein the retainer slot is substantially aligned with the first slot and is adapted to receive the stem.

6. The retainer of claim 5, wherein the retainer cap includes a cap slot substantially aligned with the first slot and the retainer slot and that is adapted to receive the stem.

* * * * *